US005775983A

United States Patent [19]

Shendon et al.

[11] Patent Number: 5,775,983

[45] Date of Patent: Jul. 7, 1998

[54] APPARATUS AND METHOD FOR CONDITIONING A CHEMICAL MECHANICAL POLISHING PAD

[75] Inventors: Norman Shendon, San Carlos; William R. Bartlett, Los Gatos, both of Calif.

[73] Assignee: Applied Materials, Inc., Santa Clara, Calif.

[21] Appl. No.: 431,934

[22] Filed: May 1, 1995

[51] Int. Cl.[6] ..... B24B 21/18; B24B 33/00; B24B 47/26; B24B 55/00

[52] U.S. Cl. ..... 451/444; 451/285; 451/287

[58] Field of Search ..... 451/56, 242, 246, 451/443, 444, 285–287; 216/88, 89; 156/636.1, 645.1; 125/11.03

[56] References Cited

U.S. PATENT DOCUMENTS 4,959,928 10/1990 Hartwig, Sr. ..... 51/262 A
5,070,570 12/1991 Sabo ..... 15/160
5,081,051 1/1992 Mattingly et al. ..... 437/10
5,154,021 10/1992 Bombardier et al. ..... 51/262 A
5,167,667 12/1992 Prigge et al. ..... 8/137
5,216,843 6/1993 Breivogel et al. ..... 51/131.1

*Primary Examiner*—James G. Smith
*Assistant Examiner*—Derris H. Banks
*Attorney, Agent, or Firm*—Fish & Richardson, P.C.

[57] ABSTRACT

A method and apparatus for conditioning a polishing pad improves the polishing characteristics of the pad by providing an embedded pattern that facilitates polishing and reduces glazing. Moreover, the present invention conditions a pad without significantly abrading the polishing surface, thereby prolonging the pad's useful life. A series of independently rotatable rollers having a knurled outer surface is used to embed a pattern of score marks in the surface of the polishing pad. Alternatively, a knurled conical roller engages a radius of the pad. The apparatus is adaptable to either manual or automated processes. The present invention is particularly useful for conditioning polishing pads used in the fabrication of semiconductor wafers.

27 Claims, 4 Drawing Sheets

APPARATUS AND METHOD FOR CONDITIONING A CHEMICAL MECHANICAL POLISHING PAD

BACKGROUND OF THE INVENTION

1. Field of the Invention

The present invention relates generally to chemical mechanical polishing of substrates, and more specifically to an apparatus and method for conditioning a polishing pad for use in a chemical mechanical polishing apparatus.

2. Description of the Related Art

In certain technologies, such as integrated circuit fabrication, optical device manufacture, and the like, it is often crucial to the fabrication processes involved that a workpiece be formed to have substantially planar front side or, for certain applications, to have both a planar front side and back side.

One process for providing such a planar surface is to scour the surface with a conformable polishing pad, commonly referred to as "mechanical polishing." Use of a polishing pad in conjunction with a chemical slurry generally provides a higher material removal rate than is possible with mere mechanical polishing. This combined chemical and mechanical polishing, commonly referred to as "CMP," is considered an improvement over mere mechanical polishing processes for planarizing or polishing substrates. Relative movement between the surface of the substrate to be polished and a wetted pad causes material to be chemically and physically polished from that surface in accordance with interface conditions therebetween. The CMP technique is common for manufacture of semiconductor wafers used for the fabrication of integrated circuit die, and for planarizing substrates on which one or more deposition film layers have been deposited and etched.

Semiconductor wafer polishing pads, generally circular in shape, are commercially available, such as models IC1000 or Suba IV of a woven polyurethane material, available from the Rodel Company, Newark, Del.

During the CMP polishing process, the polishing surface of the polishing pad changes. These changes are primarily caused by two phenomena: spent slurry accumulates in the porous surface of the polishing pad; and the loading of the substrate against the pad tends to compress the porous surface of the pad. The accumulation of the spent slurry in the porous pad surface, in combination with the compression of the pad surface, create a "glazed" condition on the pad. A glazed pad typically has a lower coefficient of friction, and thus a substantially lower material removal rate, than that of a fresh, or un-glazed, pad. When the material removal rate of the pad is lowered, the time required to polish a substrate is increased, which reduces the throughput of substrates through the polishing apparatus. Therefore, a key factor in producing consistent polishing of the substrates is the condition of the surface of the polishing pad.

One apparatus which is purported to address pad glazing, and the resulting drop in polishing rate, is shown in U.S. Pat. Nos. 5,081,051 (Mattingly et al.) and 5,216,843 (Breivogel et al.), which is essentially an improvement of the apparatus of the Mattingly et al. patent. Shown in these two patents is an apparatus and method for cutting symmetrical groove patterns in a polishing pad surface using a serrated blade and diamond-tipped device. The blade and the diamond tips cut into the pad surface, to physically tear the surface of the pad to dislodge the spent slurry and open up the compressed surface of the pad. Although this method will rejuvenate the surface of the pad, it will substantially abrade, and thereby wear, glazed and unglazed portions of the pad, resulting in substantial wear of the pad. The process is also time consuming and requires expensive equipment.

Thus, there is a need for an improved method and apparatus for conditioning polishing pads used in CMP apparatus.

SUMMARY OF THE INVENTION

The present invention provides methods and apparatus for conditioning the surface of a CMP polishing pad by providing a conditioning surface which is impressed into, and then removed from, the pad, with minimal or no relative motion between the conditioning surface in contact with the pad and the portion of the surface of the pad being conditioned, which would score the pad.

One method for conditioning a substantially circular chemical mechanical polishing pad, having a surface adapted for processing substrates includes: engaging the surface of the pad with at least one roller having a knurled outer cylindrical surface in pressurized contact with the pad, and relatively moving the pad and the rotating roller(s) such that the knurled surface(s) embed a pattern of score marks in the polishing pad surface. That is, the roller is moved over the pad with the surfaces engaging each other but not sliding. The roller may be a right circular member, wherein the outer circumferential surface thereof includes the knurling, or it may be a conical roller wherein the conical surface includes the knurling. In the multiple roller embodiment, each of the rollers provides a conditioning surface which rolls over the surface of the pad, and thereby impresses into and then removes from the pad, the individual protrusions which make up the knurled surface. This enables pad conditioning with minimal relative motion between the pad and the conditioning surface at the pad-conditioning surface interface, which ensures pad conditioning with minimal wear of the pad surface.

One configuration of the device for conditioning a surface of a chemical mechanical polishing pad, generally adapted for use in combination with a mechanism for forcibly pressing the device against the surface, includes: a plurality of rollers, each having a knurled rim; a yoke adapted to hold the plurality of rollers adjacently in a rotational, axial, alignment with the knurled rims protruding from the yoke, the yoke having a mechanism for coupling to the mechanism for forcibly pressing the device to the surface such that the rollers are pressed into the surface and create a pattern of score marks in the surface while moving in rotational contact across the surface.

In another configuration, the invention includes a conical conditioning member, which includes an outer conical surface on which the conditioning knurls or protrusions are located, and a central axis passing through the center of the conical member and preferably aligned to intersect the center of rotation of the polishing surface when the conical surface is in contact with the polishing surface. The conditioning member is preferably mounted in a support member which provides the alignment of the conical surface and central axis with the polishing surface. Additionally, the conical member is preferably free to rotate about the central axis, such that rotational motion of the conical surface about its axis is provided by the motion of the polishing surface, which causes the conical surface in contact therewith to move.

Both the conical and multiple roller aspects of the invention provide conditioning by embedding the protrusions into the pad surface, and then retracting the protrusions from the pad, with minimal, or no, movement of the protrusions within the pad in the direction of the plane of the upper surface of the pad. Therefore, the protrusions dislodge the spent slurry and pull the compressed pad outwardly, to clear the pad of the spent slurry and restore the porous nature of the pad, without substantial tearing or cutting of the pad surface. Thus, conditioning of the pad is accomplished with minimal pad wear.

The device can be adapted for manual or automated processes.

It is an advantage of the present invention that it provides a polishing pad surface that is resistant to glazing.

It is a further advantage of the present invention that the process of conditioning a polishing pad does not significantly abrade the pad, prolonging useful life.

It is still another advantage of the present invention that it provides for better distribution of slurry across the surface of a CMP polishing pad by creating small residual depressions in the polishing surface.

It is another advantage of the present invention that is relatively inexpensive to implement.

It is another advantage of the present invention that the process may be easily automated.

Other objects, features and advantages of the present invention will become apparent upon consideration of the following detailed description and the accompanying drawings, in which like reference designations represent like features throughout the FIGURES.

The drawings referred to in this description should be understood as not being drawn to scale except if specifically noted.

DETAILED DESCRIPTION OF THE INVENTION

Reference is made now in detail to a specific embodiment of the present invention, which illustrates the best mode presently contemplated by the inventor(s) for practicing the invention. Alternative embodiments are also briefly described as applicable. In each of the embodiments, the conditioning apparatus provides a conditioning surface which, at least in part, does not move relative to the surface of the polishing surface where it contacts the pad.

General Description

Figure 1:
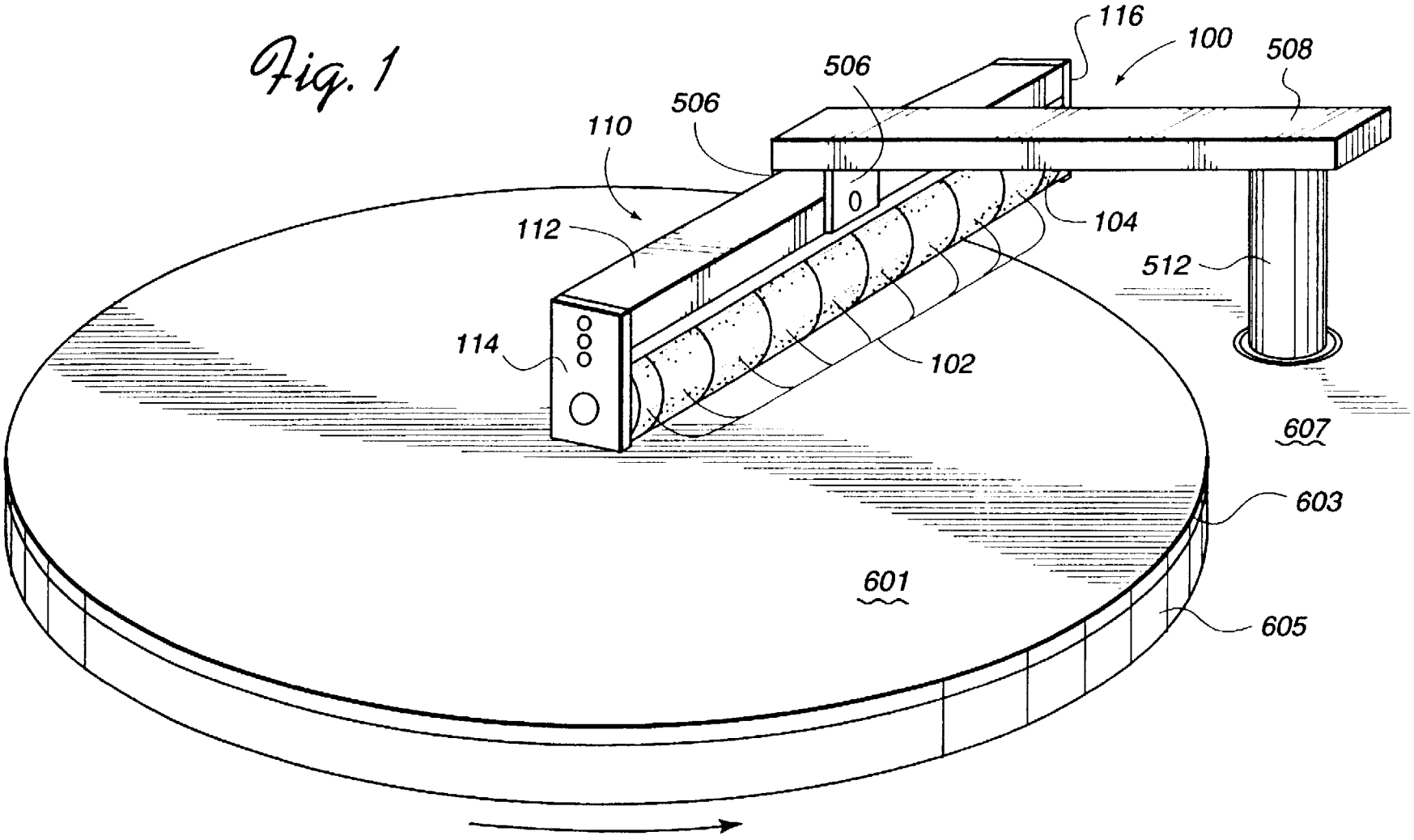
FIG. 1 is a perspective view of the apparatus of the present invention.

A chemical mechanical polishing (CMP) apparatus, as shown in FIG. 1, includes a replaceable polishing pad 603 mounted on a rotatable platen 605. The platen 605 is rotatably mounted on a chassis 607 and is driven by an unillustrated motor. As is well known, a wafer is pressed against a surface 601 of the rotating polishing pad 603 so as to polish, planarize, or otherwise remove surface material from the wafer.

A conditioning tool 100 disposed over the rotating pad 601 and platen 605 conditions a surface 601 of the polishing pad 603 to maintain its polishing characteristics. The tool 100 includes a series of adjacent main rollers 102 and an end roller 104. In the embodiment shown, nine main rollers 102 are provided having a common axis of rotation. However, the number of rollers 102 employed can change with the specific design implementation. An end roller 104 having a different configuration is located at the outside extremity of the series of adjacent main rollers 102. The rollers 102, 104 provide a cylindrical conditioning surface which is positioned on the pad to provide the conditioning as will be further described herein.

Roller Features

Figure 2:
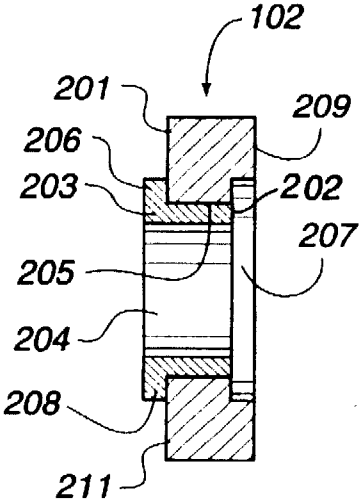
FIG. 2 is a cross-sectional plan view of a roller employed in the present invention as shown in FIG. 1.

As shown in FIG. 2, each main roller 102 is a right circular member having a knurled outer surface 201; that is, the main roller 102 is a wheel having a toothed outer rim surface. The knurling is in a predetermined pattern, which is a negative footprint of the pattern that is desired to be scored into the surface of the polishing pad. In other words, the pattern of knobs, protrusions, or ridges formed on the outer cylindrical surface 201 of each roller 102 will embed a complementary pattern of indentations into the surface across which the roller 102 is wheeled under a pressure exerted (generally perpendicularly to the surface of the pad) between the surface and the outer cylindrical surface 201.

Figure 4:
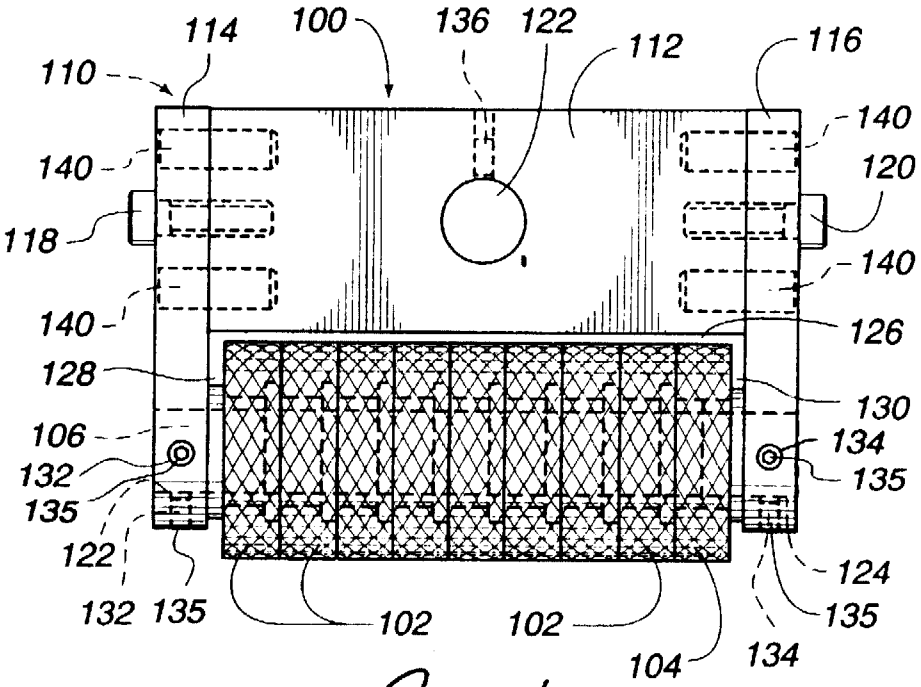
FIG. 4 is a plan view (side) of the present invention as shown in FIG. 1.

Each main roller 102 has a central bore 205 having a diameter for receiving a hub insert 203 therein. Each roller 102 also has a cutout (or counterbore depression) 207 in one side face 209. The hub insert 203 includes a cylindrical portion 202 which is received in the central bore 205, and includes a bore 204 therethrough and through which a shaft 106 may be inserted (as shown in FIG. 4). The hub insert 203 also includes a flange 206, which bears against the side face 211 of the roller 102, and which includes an outer cylindrical alignment face 208 extending outwardly from the side face 211 of each main roller 102.

The rollers 102 are designed to be nested together about the shaft 106 such that adjacent knurled cylindrical surfaces 201 blend together into a continuous conditioning surface of the tool 100. To provide this feature, the cutout 207 has a diameter greater than the shaft diameter and is essentially the same as the outer diameter of the alignment face 208 on the hub insert 203. Thus, by inserting the flange 206 of one roller 102 into the recess 207 of an adjacent roller 102, a number of main rollers 102 can be loosely slip-fit together, i.e., nested, and the outer cylindrical surfaces thereof will be cylindrically aligned. However, because each roller 102 is free to rotate with respect to any adjacent roller 102, each roller 102 is free to rotate individually about the shaft 106.

End Roller Features

Figure 3:
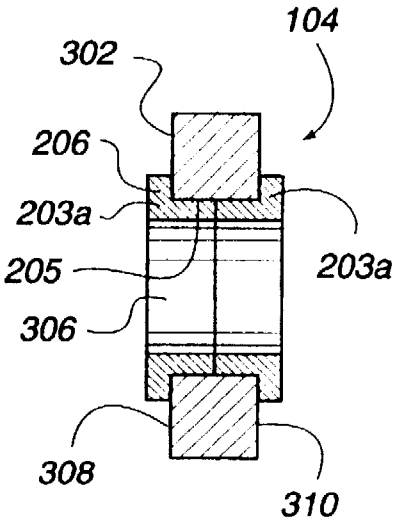
FIG. 3 is a cross-sectional plan view of an end roller employed in the present invention as shown in FIG. 1.

To complete an array of rollers 102 such as those shown in FIG. 1, a specialized end roller 104 is needed, as shown in FIG. 3, in cross-section. The end roller 104 has the knurled outer circumferential surface 201 of the previously described main rollers 102. The only difference between an end roller 104 and a main roller 102 is that an end roller 104 does not have a recess 207, and two insert hubs 203*a* are extended into the bore 205 thereof such that a flange 208 is located on both of the end faces 209, 211 of the roller 104. The flange 206 on the additional hub insert 203 provides spacing between the roller 104 and adjacent tool surfaces, as will be further described herein.

Roller Common Features

Figure 6:
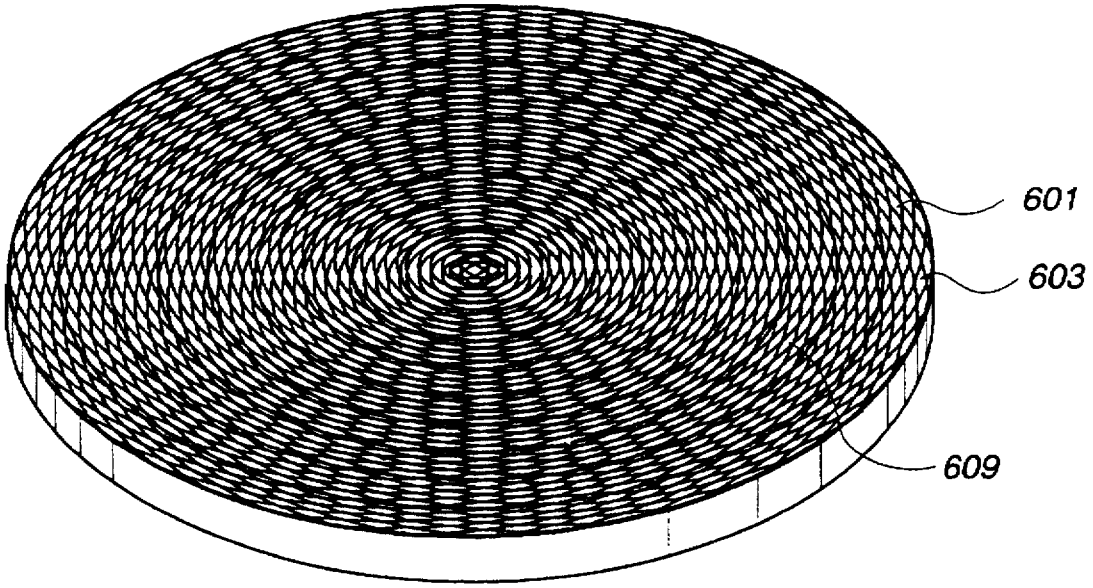
FIG. 6 is a schematic depiction of a region of the surface of a polishing pad conditioned using the present invention as shown in FIGS. 1, 2 and 3.

In the preferred embodiment, a multidirectional protruding shape is provided as the conditioning surface 201, such as by providing bidirectional, diamond-shaped teeth (not shown) on the outer circumferential surface 201 of each roller 102, 104, which create a complementary pattern in the surface of the polishing pad when the rims of the tool 100 are rolled over the pad surface. In essence, if a diamond-shaped knurling is provided on the rollers 102, 104, a checkerboard pattern can be embedded into the surface 601 of the pad 603 as shown in FIG. 6. Other multidirectional ridge or knob patterns can be adopted for specific implementations.

The height dimension of the knurl features is variable. Each design will be dependent upon factors such as the predetermined pattern selected, the nature of the materials used to form the components of the tool 100 and their inherent mass, the amount of pressure exerted between the pad surface and the rollers 102, 104 and the like. However, in each design the protrusions should be capable of pushing into the pad, and then being pulled from the pad as the roller passes each location on the pad, to dislodge spent slurry and other materials which contribute to the "glazed" condition of the pad.

Mounting of the Rollers for Nesting

Figure 5:
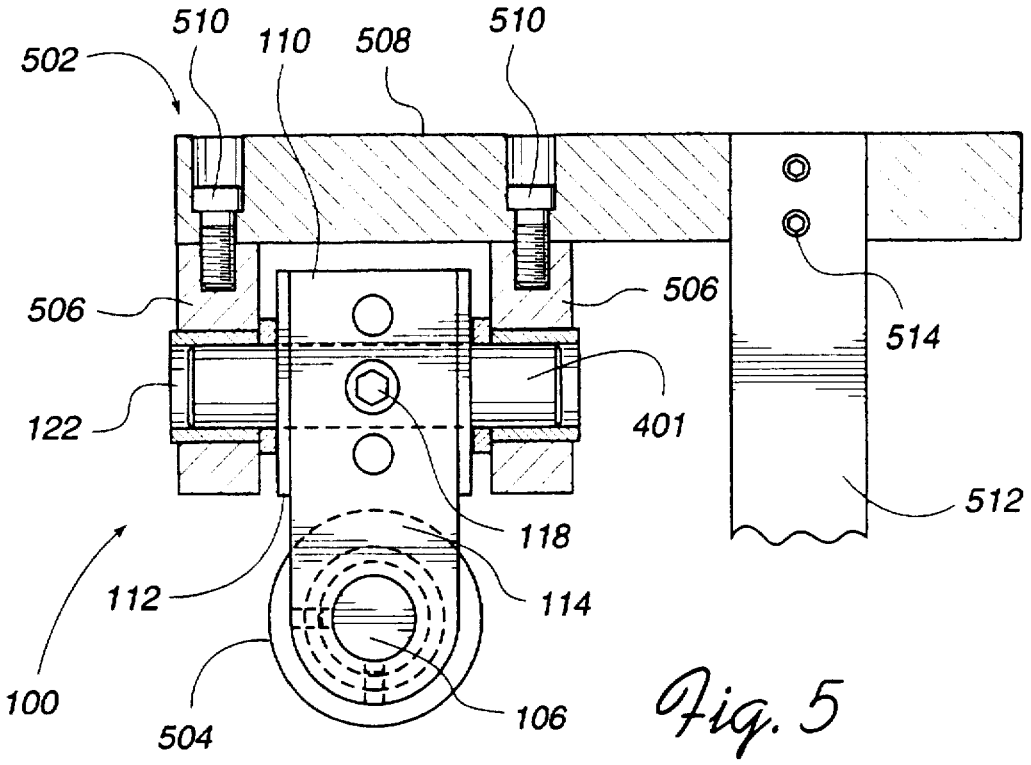
FIG. 5 is a plan view (side) of the present invention as shown in FIG. 2 as mounted on an adapter.

To provide a conditioning tool, the rollers 102, 104 are nested end to end as illustrated in FIGS. 1, 4 and 5. In this manner, an axially aligned bank of adjacent rollers 102, 104 is formed. Note that the rollers 102, 104 are generally abutting on the roller shaft 106, yet free to rotate at different rates about their common rotational axis because of the slip-fit of each flange 206 into an adjacent cutout 207.

To provide positioning of the bank of rollers 102, 104 nested over the shaft 106 relative to the pad surface, the roller shaft 106 is in turn mounted in a yoke 110. The yoke 110 consists of a pivot block 112 and two side plates 114, 116. Two capture bolts 118, 120 mount the side plates 114, 116 to the pivot block 112. The pivot block 112 is provided with an aperture 122 for receiving a pivot shaft 401 (shown in FIG. 5) therethrough. The yoke 110 is formed by having the two side plates 114, 116 extend beyond the perimeter of the pivot block 112 to capture the roller shaft 106 through apertures 122, 124 provided in the extension regions of each side plate 114, 116, respectively. The main rollers 102 and end roller 104 mounted on the roller shaft 106 are separated from the pivot block 112 by a predetermined clearance 126. The mounted main rollers 102 and end roller 104 are also separated from the side plates 114, 116 by predetermined clearances 128, 130. The clearances 128 and 130 are equal to the width of the flanges 206 on each insert hub 203 or 203*a*. These flanges 206 extend between the rollers 102, 104 and the adjacent side plate 114, 116 to provide a bearing surface through which side loading of the rollers is passed to the side of plates 114, 116.

The rotation of the rollers 102, 104 on the shaft 106 will tend to rotate the shaft 106. Therefore, the shaft is locked against rotation by providing set screw receiving holes 132, 134 in the yoke 110 and locating set screws 135 therein. The set screws 135 are tightened against the shaft 106 to prevent rotation of the shaft 106. The rotation of the rollers 102, 104 will also induce a moment at the connection of the shaft 106 and the sideplates 114, 116, which will tend to cause the sideplates to rotate about the shaft 106 in opposite directions and cause binding of the rollers 102, 104. To prevent this movement, dowel pins 140 extend through the side plates 114, 116 and into the pivot block 112 to lock the side plates into a fixed position relative to the shaft 106 and the pivot block 112.

Adapters

Turning now to FIG. 5, the polishing pad conditioning tool 100 of the present invention is shown mounted to an exemplary adapter assembly 502 which can be designed to suit any particular manual, robotic, or otherwise automated pad conditioning station as necessary. That is, an adapter can be devised for manual use of the tool, such as a simple handle, or for a specific assembly line or other manufacturing automation.

In the exemplary embodiment, a plurality of rollers 102, 104 in one or more adjacent yokes 110 are held in place by the pivot shaft 401 being fitted through two pivot plates 506 depending from a horizontal cross plate 508, attached thereto by screws 510. The horizontal cross plate 508 is attached to a guide bar 512 by fasteners 514. The guide bar 512 is mounted on the chassis 607 of FIG. 1, but may be selectively rotatable and vertically movable with respect to the chasis 607. The adapter assembly 502 is configured such that a predetermined pressure can be exerted between the rollers 102, 104 and the surface of a polishing pad to be conditioned. The biasing may be provided, for example, by selectively spring loading the guide bar 512 against the chassis 607 to downwardly bias the rollers 102, 104 against the pad 603.

The adaptor is used to position the rollers 102, 104 across the surface 601 of the polishing pad 603 to provide a patterning of the surface 601 as shown in FIG. 6.

Operation

Referring again to FIG. 1, in operation the pad 603 is circular and mounted on the platen 605 which generally has a planar, rotational motion. The adapter assembly 502 is lowered such that the axis of the rollers 102, 104 usually extends radially across the pad 603 and the rollers 102, 104 are positioned in contact under pressure across all or part of a surface 601 of a pad 603 to be conditioned. The pad 603 is rotated. Note that the construction of the bank of rollers 102, 104 allows the radially innermost roller to rotate at a substantially lower rotational rate than the radially outermost roller such that the pattern embedded in the pad is aligned appropriately. The rollers rotate as the pad moves, because the protrusions on the rollers 102, 104 extend into the pad in a gear-like meshing, which causes the motion of the pad to rotate the rollers 102, 104 about the shaft 106.

In an ideal implementation, the entire pad surface 601 has been conditioned after one revolution of the pad 603. That is, the knurling on the rollers 102, 104 creates a pattern of score marks across the entire pad surface 601 in one pass. Due to manufacturing tolerances, pad surface non-planarity, difference in pad materials, and other like variables, several passes over the pad surface 601 are likely to be required to complete the conditioning.

As with the design of the knurling on the rollers 102, 104, pressure ranges sufficient to embed a first series of score marks 609 in the pad surface 601 are implementation specific. It may be found that different patterns and different forces used to embed the pattern achieve different results in conditioning the pad. Experimentation with different shapes and sizes of teeth on the rollers 102, 104 for different pad materials may be in order.

Alternatively, the pad 603 to be conditioned can be secured during conditioning. The tool 100, specifically the series of rollers 102, 104, is run across the pad 603 with a predetermined pressure.

With either relative motion of the pad and rollers, the entire surface of the pad can be scored in one or more passes of the rollers.

Moreover, the tool 100 can be lifted after the first scoring of the polishing pad surface and its shaft pivoted with respect to the pad radius such that when re-engaged with the pad surface 601, the rollers 504 will embed a second series of score marks 609 in a second direction, up to and including a pattern orthogonally oriented with respect to the first series of score marks 609.

In this manner, a pattern, either symmetrical or random can be embedded in the pad surface 601.

By providing multiple, individual rollers, the conditioning apparatus 100 will condition the pad 601 with minimal tearing or cutting of the pad 601 because the individual rollers 102, 104 will rotate at different speeds as the pad revolves under the rollers 102, 104. Nonetheless, within each roller path, the pad will move under the roller faster than the mean velocity of the outer cylindrical surface 201 at a position adjacent to the outermost side (as referenced from the pad center) of the roller, and slower than the mean velocity of the outer cylindrical surface 201 at a position adjacent to the innermost side of each roller. This geometrical phenomenon occurs because the roller is a rigid member which cannot adjust for the different linear velocities present at the span of radial pad positions it contacts. To minimize any tearing or scoring of the pad 601 which could occur as a result of the differential velocity between portions of the pad and the roller, the roller width is minimized such that the rollers have individual widths no greater than 2.5 to 3 cm. Additionally, smaller rollers, having widths as small as the width of an individual knurl protrusion, are specifically contemplated. Further, the width of the rollers may be graduated, such that the roller adjacent the center of the pad is on the order of one knurl protrusion wide, and the roller width is increased as the distance from the pad center is increased.

Alternative Embodiment

Figure 7:
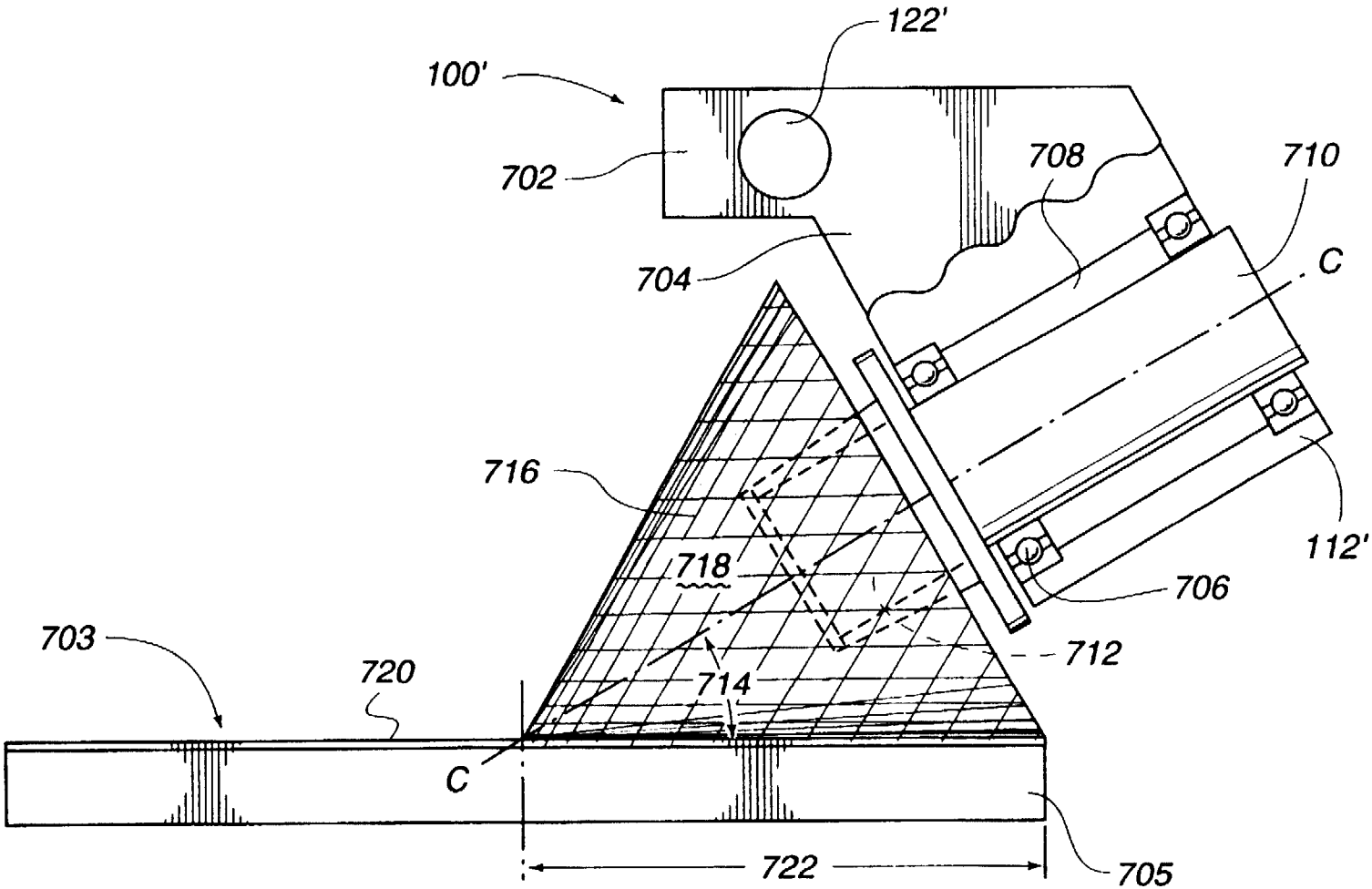
FIG. 7 is a perspective of an alternative embodiment of the apparatus of the present invention.

An alternative embodiment of the tool 100' of the present invention is shown in FIG. 7. In this embodiment of the invention, the series of nested rollers is replaced with a conical roller 716, having an outer conical face 718 which is engageable against the surface of the pad 703.

To position this conical roller on the pad 703, pivot block 112', or housing, is mounted on a pivot 122'. Pivoting the block 112' about the pivot 122' moves the conical roller 716 away from the polishing pad 703 mounted for conditioning on a platen 705. The pivot block 112' has a horizonal support section 702 and an angularly descending portion 704. A guide bore 701 extends through the descending portion, and it includes an axis 705 therethrough which, when extended from the guide bore 701, intersects the planar surface of the pad 703 at an acute angle 714. A rotating shaft or journal 710 is supported within the bore 701 in a pair of bearings 706, 706' which are provided in counterbored pilots 707, 707' at opposed ends of the bore 701. Preferably, the bearings 706, 706 are roller bearings although other bearings, and bearing configurations, may be used.

The rotating shaft 710 includes an extension portion 712 which protrudes from the bore 701 in the direction of the pad 703. The extension portion 712 has an axis of rotation 704 which is collinear with the axis 705 of the bore 701. Thus, the axis 710 of the extending portion 712 is also disposed at the angle 714 to the pad 703.

To provide the conditioning of the pad 703, a conical roller 716 having a knurled surface 718 is mounted to the extension portion 712 of the shaft 710. When the tool 100' is in position to condition the polishing surface 720 of the pad 703, the knurled surface 718 is in full linear contact with the pad surface 720. The hypotenuse dimension 722 of the conical shape of the roller 716 is preferably equal to the radius of the polishing pad 703 to improve efficiency in operation such that the conical axis 715 of the cone shaped roller 716 intersects the rotational center of the pad 703. In this case, the conical roller 716 can move relative to the pad 703 with no differential slippage across the pad surface, i.e., the increasing diameter of the conical roller provides a greater circumference of protrusion surface for conditioning the pad surface as the diameter of the pad increases, and thus a greater length of conditioning surface, as the distance on the knurled surface from the center of the pad increases. Thus, the conditioning may be accomplished with no linear movement of the protrusions in the plane of the pad as the protrusions are presented into and removed from, the surface 720 of the pad 703. This results in zero, or approximately zero, pad wear from conditioning, because the glazed material is agitated out of, rather than torn from, the pad 703. The platen 705 and a pad 703 affixed thereto, or the tool shaft, can be rotated to pass the knurled surface 718 of the roller 716 across the entire surface 720 of the pad 703. One or more passes in the same or varying relative orientations may be performed to condition the pad surface 720.

The conical roller 716 has the additional advantage of not being clogged by slurry deposits if a used pad is reconditioned in accordance with the present invention, because no crevices or gaps are present through which slurry could flow to reach bearings or other internal elements of the conditioning apparatus.

The foregoing description of the preferred embodiments of the present invention has been presented for purposes of illustration and description. It is not intended to be exhaustive or to limit the invention to the precise form disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application to thereby enable others skilled in the art to understand the invention for various embodiments and with various modifications as are suited to the particular use contemplated. Subtitles used herein to divide the specification are for convenience only and not intended as limitations on the scope of the invention. It is intended that the scope of the invention be defined by the claims appended hereto and their equivalents.

What is claimed is:

1. A device for conditioning a polishing surface, said device adapted for use in combination with a means for forcibly pressing said device against said polishing surface, comprising: a plurality of rollers each having a knurled outer surface and coupled to form a bank of independently rotatable rollers.

2. The device as set forth in claim 1, further comprising a yoke adapted to hold said plurality of rollers adjacently along a common axis with said knurled outer surface of each roller protruding from said yoke, said yoke having a means for coupling to said means for forcibly pressing said device against said polishing surface such that said plurality of rollers are pressed into said polishing surface and create a pattern of score marks in said polishing surface while moving in rotational contact across said polishing surface.

3. The device as set for in claim 2, wherein each of said rollers is coupled to an adjacent roller by:

a hub protruding axially from one side of each of said rollers and having a first shape and dimension, and a cutout region located in an opposite side of each of said rollers and having a second shape and dimension complementary to said first shape and dimension such that said plurality of rollers can be nested by slip-fit to form said bank of independently rotatable rollers.

4. The device as set forth in claim 2, wherein said knurled outer surface has a predetermined pattern of protrusions having a multidirectional orientation.

5. The device as set forth in claim 2, wherein said yoke further comprises a shaft member extending axially along said common axis through said plurality of rollers such that a first roller is positionable at an approximate center of said polishing surface and a roller distally located from said first roller is at an approximate periphery of said polishing surface.

6. The device as set forth in claim 2, further comprising a rotatable platen on which said polishing surface is mounted and wherein said common axis of said plurality of rollers is aligned with a radius of said platen.

7. The device as set forth in claim 2, wherein said means for coupling said yoke further comprises means for pivoting said yoke to move said plurality of rollers from a first predetermined axial alignment with respect to said polishing surface to a second predetermined axial alignment with respect to said polishing surface.

8. A tool for conditioning a substantially circular chemical mechanical polishing pad used in the processing of semiconductor wafers, said polishing pad having a predetermined radius, comprising:

an adapter for holding said tool in a predetermined orientation to a surface of said polishing pad to be conditioned;

a yoke member coupled to said adapter; and a bank of abutting rollers having a length approximately equal to the radius of said polishing pad, said rollers coupled to said yoke member via an axial shaft on which said rollers are adjacently mounted for rotation thereabout, each of said rollers having peripheral protrusions extending outwardly from said yoke.

9. The tool as set forth in claim 8, wherein each of said rollers further comprises:

a knurled outer surface having a predetermined pattern of knurled protrusions having a bi-directional orientation.

10. The tool as set forth in claim 8, wherein each of said rollers further comprises:

a circular insert protruding axially from one side of each of said rollers and having a predetermined external diameter, and a circular depression located in an opposing side of each of said rollers and having a diameter complementary to said predetermined external diameter such that said rollers can be nested to form said bank of abutting rollers.

11. The tool as set forth in claim 8, wherein said adapter comprises a handle for manually engaging said tool with said surface.

12. The tool as set forth in claim 8, wherein said adapter comprises an assembly for holding said tool in pressurized contact with said surface of said polishing pad with said rollers extending radially from an approximate center of said polishing pad to an approximate periphery of said polishing pad such that rotation of said polishing pad turns said rollers.

13. An apparatus for conditioning a surface of a polishing pad, comprising:

a housing;

a bearing having a bushing fixedly mounted to said housing and a journal for relative rotational motion with respect to said bushing; and a roller having a conical outer surface and peripheral knurling across said outer surface, mounted to said journal for rotation therewith such that said outer surface is in forced contact with said surface of said polishing pad.

14. The apparatus as set forth in claim 13, wherein said polishing pad is substantially circular and has a predetermined radius, and said conical outer surface has a hypotenuse dimension approximately equal to said predetermined radius.

15. The apparatus as set forth in claim 13, wherein said peripheral knurling further comprises a predetermined pattern of protrusions having a multidirectional orientation.

16. The apparatus as set forth in claim 13, wherein said housing further comprises a handle adapted to facilitate application of pressure force between said outer surface of said roller and said surface of said pad.

17. A conditioning tool for conditioning a pad affixed to a rotatable platen, comprising: a plurality of rollers having a patterned circumferential surface and being independently rotatable on a shaft disposed along a radius of said platen and biased in parallel toward said platen.

18. A conditioning tool as recited in claim 17, wherein said patterned surface is knurled.

19. A conditioning tool as recited in claim 17, wherein each of said rollers includes an insert bearing against said shaft, at least some of said inserts having flange portions extending longitudinally outside said patterned circumferential surfaces of associated ones of said rollers and fittable into recesses formed in neighboring ones of said rollers.

20. A conditioning tool as recited in claim 17 wherein said platen is rotatably mounted on a chassis and said plurality of rollers are mounted on said chassis and selectively biased toward said platen.

21. A conditioning tool for conditioning a polishing pad disposed on a rotating platen, comprising a knurled rotatable surface disposed substantially along a radius of said platen, said knurled surface having multiple portions being rotatable substantially at respective speeds of adjacent portions of said rotating platen, whereby said knurled rotatable surface reduces tearing of said polishing pad.

22. A conditioning tool as recited in claim 21, wherein said knurled rotatable surface comprises knurled surfaces of a plurality of rollers mounted on a shaft.

23. A conditioning tool as recited in claim 21, wherein said knurled rotatable surface comprises a surface of a rotatable conical member.

24. A method for conditioning a substantially circular chemical mechanical polishing pad having a surface adapted for polishing substrates, comprising:

engaging the surface of the polishing pad with a plurality of axially aligned independently rotatable rollers having knurled outer surfaces in pressurized contact with the polishing pad; and providing relative motion between the pad and said rollers such that said knurled outer surfaces embed a pattern of score marks in said surface of said polishing pad.

25. The method as set forth in claim 24, wherein the step of providing relative motion further comprises crossing said pad to simultaneously score the entire surface of said pad in one pass.

26. The method as set forth in claim 24, further comprising:

engaging said rollers along a radius of said pad; and rotating said pad with said knurled outer surfaces in pressurized contact with said surface.

27. The method as set forth in claim 24, further comprising:

moving said pad or said rollers to a second orientation; and moving said pad relative to said rollers such that said knurled outer surfaces embed a second pattern of score marks in said surface.

* * * * *

UNITED STATES PATENT AND TRADEMARK OFFICE

CERTIFICATE OF CORRECTION

PATENT NO. : 5,775,983

DATED : July 7, 1998

INVENTOR(S) : Shendon et al.

It is certified that error appears in the above-identified patent and that said Letters Patent is hereby corrected as shown below:

Title page in U.S. PATENT DOCUMENTS add --4,287,687 9/81 Wilson 451/285
4,438,601 3/84 Olson 451/444
5,074,457 12/91 Matsuki et al. 228/158
5,486,131 1/96 Cesna et al. 451/285--.

Signed and Sealed this

Twenty-third Day of March, 1999

*Attest:*

Q. TODD DICKINSON

*Attesting Officer*

*Acting Commissioner of Patents and Trademarks*